US008385574B2

(12) United States Patent
Aquilina et al.

(10) Patent No.: US 8,385,574 B2
(45) Date of Patent: Feb. 26, 2013

(54) MULTIPART COMPARTMENT FOR A HEARING SYSTEM

(75) Inventors: Paul C. Aquilina, Kitchener (CA); Li Li, Mississauga (CA); Tad D. Ell, Savage, MN (US)

(73) Assignee: Phonak AG, Stafa (CH)

( * ) Notice: Subject to any disclaimer, the term of this patent is extended or adjusted under 35 U.S.C. 154(b) by 314 days.

(21) Appl. No.: 12/703,857

(22) Filed: Feb. 11, 2010

(65) Prior Publication Data

US 2010/0220884 A1 Sep. 2, 2010

Related U.S. Application Data

(63) Continuation-in-part of application No. PCT/EP2009/051700, filed on Feb. 13, 2009.

(51) Int. Cl.
*H04R 25/00* (2006.01)

(52) U.S. Cl. ..... 381/328; 381/23.1; 381/329; 381/380

(58) Field of Classification Search ..... 381/330, 381/87, 328, 23.1, 329, 380
See application file for complete search history.

(56) References Cited

U.S. PATENT DOCUMENTS

| | | | | |
|---|---|---|---|---|
| 3,197,576 | A * | 7/1965 | Martin | 381/322 |
| 6,022,311 | A | 2/2000 | Juneau et al. | |
| 7,372,972 | B2 * | 5/2008 | Ach-Kowalewski et al. | 381/328 |
| 7,635,047 | B2 * | 12/2009 | Bordewijk | 181/135 |
| 7,720,244 | B2 * | 5/2010 | Espersen et al. | 381/330 |
| 2001/0043708 | A1 | 11/2001 | Brimhall | |
| 2002/0027996 | A1 | 3/2002 | Leedom et al. | |
| 2006/0098836 | A1 * | 5/2006 | Sabick et al. | 381/380 |
| 2008/0170714 | A1 | 7/2008 | Major | |

FOREIGN PATENT DOCUMENTS

WO 2005069683 A1 7/2005

OTHER PUBLICATIONS

International Search Report for PCT/EP2009/051700 dated Jun. 2, 2009.

* cited by examiner

*Primary Examiner* — Curtis Kuntz
*Assistant Examiner* — Amir Etesam
(74) *Attorney, Agent, or Firm* — Pearne & Gordon LLP

(57) ABSTRACT

A hearing system and/or earpiece assembly is comprising an assembly structure with at least three parts. The parts are removably connectable and at least one of the parts can be arranged in relation to another one in a different orientation. Alternatively or in addition, at least one part is made out of a flexible material.

9 Claims, 3 Drawing Sheets

MULTIPART COMPARTMENT FOR A HEARING SYSTEM

The present invention refers to a hearing system according to the introduction of claim 1, and in particular to a multipart compartment earpiece for a hearing system, such as e.g. a three-part compartment.

Hearing systems, such as e.g. hearing devices, as in particular current custom in-the-ear (ITE) hearing instruments, hearing protectors, headsets and the like usually have a hard, contiguous shell enveloping the entire set of internal components of the hearing system.

One consequence of today's usually used embodiment for an earpiece of a hearing system is that servicing requires cutting open the hard shell.

Furthermore, hearing systems have disadvantages regarding fit rate comfort retention and sealing for hearing protection devices Customized earpieces do not have these disadvantages but require complicated service and manufacturing chains, including e.g. impression taking, scanning, modelling, manufacturing of shells, delivery and seal testing.

Many customers require generic solutions to reduce costs, ease logistics and handling of service and spare parts.

Another problem is that each earpiece of a custom hearing device is suitable only for either the right or the left ear print of one single user. In other words, e.g. the same in-the-ear custom unit hardware cannot be used by multiple users, nor can it be used for both ears of the same user.

The above mentioned features generate an elaborate custom product process destined to customize the fitting of each earpiece unit to a specific ear of a specific user.

A few solutions to at least partially solve the above mentioned problems are known from the state of the art. For instance, the U.S. Pat. No. 5,701,348 proposes a hearing device comprising a main module adapted to contain microphones, signal processing units etc. and a receiver module adapted to contain a receiver. So that the two modules can be at least introduced in a relatively flexible manner into an ear canal a connector of the two modules is proposed which gives a certain free movement between the two modules.

The WO 99/39548 proposes a hearing instrument adapted for positioning in an external auditory canal of a human proximal to the tympanic membrane. It includes a substantially rigid shell and a relatively flexible tip member.

Furthermore, the US 2002/0027996 proposes a disposable modular hearing aid with a plurality of shell parts. The various parts can be assembled in a modular manner to replace e.g. an earpiece as disposable part.

The U.S. Pat. No. 6,022,311 finally proposes a soft hearing aid which comprises one shell-part which is effectively soft and which is made out of an elastomer material with a Shore Hardness of approximately 3 to 55 Durometer Shore A.

All the proposed solutions enable the placement of a hearing device with a certain flexibility, taking individual, at least very similar ear canal geometries into consideration. But the use of the same earpiece of a hearing system, e.g. for the right and the left ear, is not possible and furthermore, use for a plurality of users with different ear canal geometries is not possible as well.

It is therefore an object of the present invention to propose an earpiece for a hearing system which can be used in a universal manner, i.e. that it can be used either for the right ear as well as for the left ear of the same user or for different users.

In particular, it is an object of the present invention to propose an in-the-earpiece for a hearing system for universal use to solve the above mentioned problems.

Accordingly, a hearing system, as in particular an earpiece for a hearing system, is proposed according to the wording of claim 1.

Proposed is a hearing system which comprises a shell or compartment for the various hearing system components comprising at least three parts which can be removably assembled, or which can be assembled in a different orientation one to each other, or of which at least one part is flexible.

According to one embodiment, it is proposed to use three shell or compartment parts in the hearing instrument as e.g. a first hard rigid shell for e.g. electronic parts, power supply, microphones etc., a second receiver compartment or shell which can accept various dome designs at its tip and a third flexible middle compartment or shell, which connects the two above mentioned parts or shells. The flexibility of this third part could be such that it is possible to adjust the angle of an individual's canal upon entry of the instrument into the ear.

According to a further embodiment, it is also possible that the third middle part can be connected to at least one of the two other parts, such that the middle compartment is reversibly mountable, thus resulting in fitting the right or the left ear.

It is e.g. proposed that the three parts can be assembled with a locking mechanism that interlocks the middle e.g. flexible compartment with the hard shell of the first part and/or with the second part, such as the receiver compartment. In other words, the locking mechanism can also interlock the receiver compartment and the middle flexible compartment.

Both locking mechanisms as mentioned above allow a snap-fit assembly. The snap action is reversible e.g. for servicing purpose.

Of course, the shell or compartment of e.g. hearing device can also have more than three parts, as e.g. in case that the hard first part-shell is made out of two shell half parts.

E.g. the following products may be built based on the basis of the above mentioned principle, which means an assembly of at least three parts, which are removably connectable and/or which can be arranged one in relation to the other in a different orientation:

- Hearing devices such as e.g. in particular in-the-ear (ITE) hearing instruments
- In-the-ear radio earpieces, which may combine transducer technology with digital signal procession,
- In-the-ear communication devices comprising an assembly of one or more microphone and a speaker, which may be connected via cable or wirelessly to a communication terminal, such as a portable radio device
- Wired or wireless headsets comprising at least one of speaker and/or at least one microphone
- Generic hearing protection devices providing for passive and/or active (dynamic, level-dependent) hearing protection,
- Generic hearing protection device with at least one of speaker and/or at least one microphone to be used as a communication terminal, such as a portable radio device,
- Noise reduction headsets,
- In-the-ear radio receivers, etc. etc.

The above list is only giving examples and is not at all terminatory.

The inventive embodiments are described by examples, as shown within the attached figures, which show e.g. an in-the-ear hearing device, which has to be introduced into a user's ear canal.

The figures show:

FIG. 1 shows schematically an inventive in-the-ear (ITE) hearing instrument in exploded view.

Figure 1:
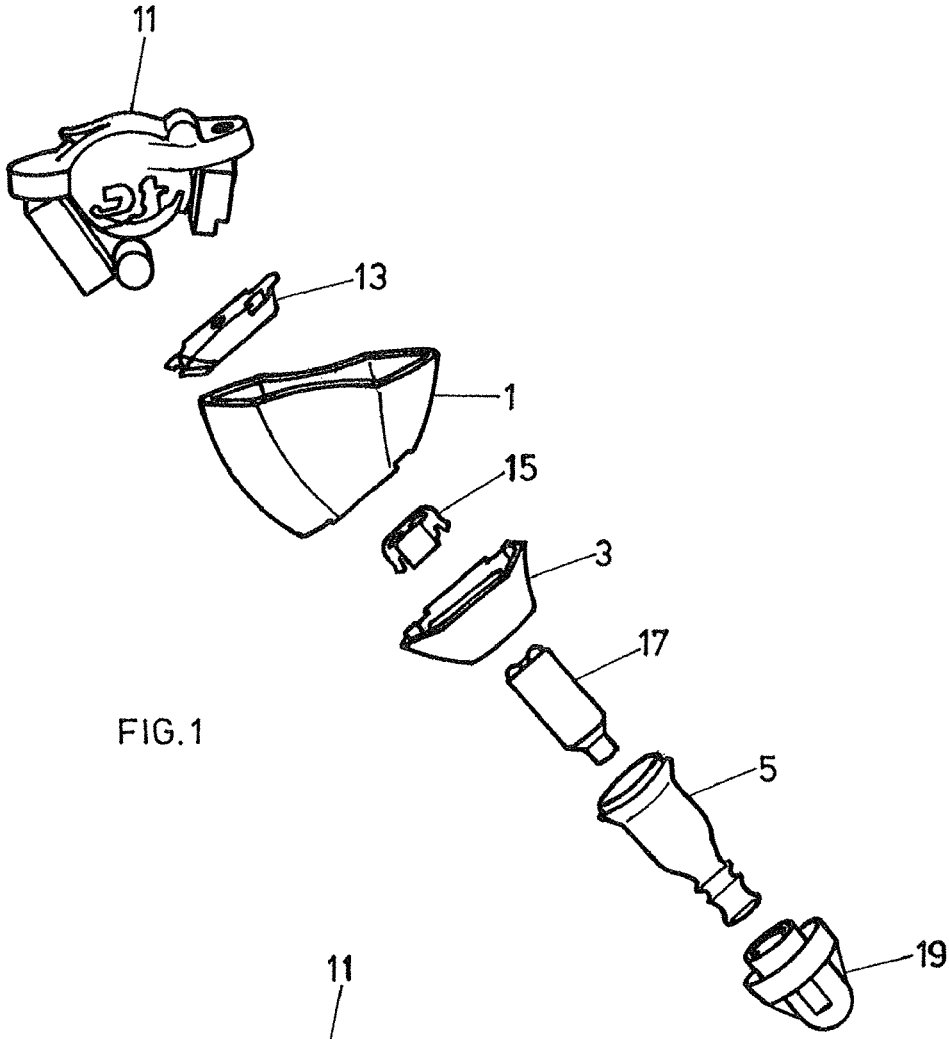
FIG. 1 shows an inventive hearing instrument in an exploded view.

The hearing instrument comprises as principle shell parts a e.g. rigid or hard first protective shell 1, in which e.g. electronics and power supply 11 can be introduced. At the bottom of this hard shell 1, a shell-snap mechanism 13 can be inserted for a releasable snap-connection with a following flexible middle compartment 3, which is an intermediate compartment to connect the hard shell 1 with a receiver housing compartment 5 in which the receiver 17 can be introduced. For a releasable snap-connection between the flexible middle compartment 3 and the receiver housing 5, a further receiver snap mechanism 15 can be introduced within the flexible middle compartment.

At the end of the receiver housing 5, a flexible dome 19 might be arranged.

The flexible middle compartment can be connected to the half-shell 1 and the receiver housing compartment 5 such to adjust the angle of an individual's ear canal upon entry of the instrument into an ear.

The middle flexible component 3 can be an enveloping structurally empty chamber. As such the usually trapped air acts as a sound dampening mechanism which reduces the energy transfer produced in the receiver compartment from being picked up by components (microphone) in the sound-receiving shell. In addition, the flexible nature of the middle envelope compartment also acts as an energy absorber helping to dampen the energy transfer.

An additional function of the two snap mechanisms, items 13 and 15 in FIG. 1, is to establish a physical barrier to the energy generated by the receiver compartment. In addition the two snap mechanisms 13 and 15 preferably include e.g. a small central hole to allow passage of e.g. wires that conduct the electrical energy generated in the shell module to the receiver module.

Particularly, the ear tip 19 can be a sealing ear tip made of silicon, foam or other material providing for sound attenuation The ear tip 19 can as well be a customized ear tip, which is flexibly connected to the other elements of the device, such as to provide for a generic functional unit comprising at least part of the functional elements and a customized ear tip providing for good sealing and good comfort. The flexible connection to the main unit significantly increases the fit rate of such a device.

Figure 2:
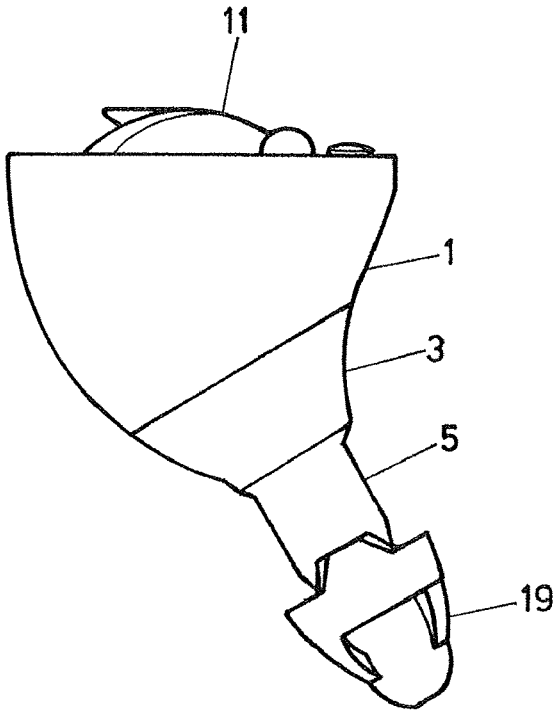
FIG. 2 shows the assembled hearing instrument, shown in parts within FIG. 1.

FIG. 2 shows again schematically the various parts as shown in FIG. 1 in an assembled arrangement. Within the hard shell 1, again the electronics and the power supply 11 is inserted. Abutting to the hard shell 1, the flexible middle compartment 3 is arranged, connecting the hard shell 1 directly with the receiver housing compartment 5. The receiver housing compartment could be either again a rigid hard shell or could also be made out of a flexible material such as e.g. a polymeric material.

Figure 3:
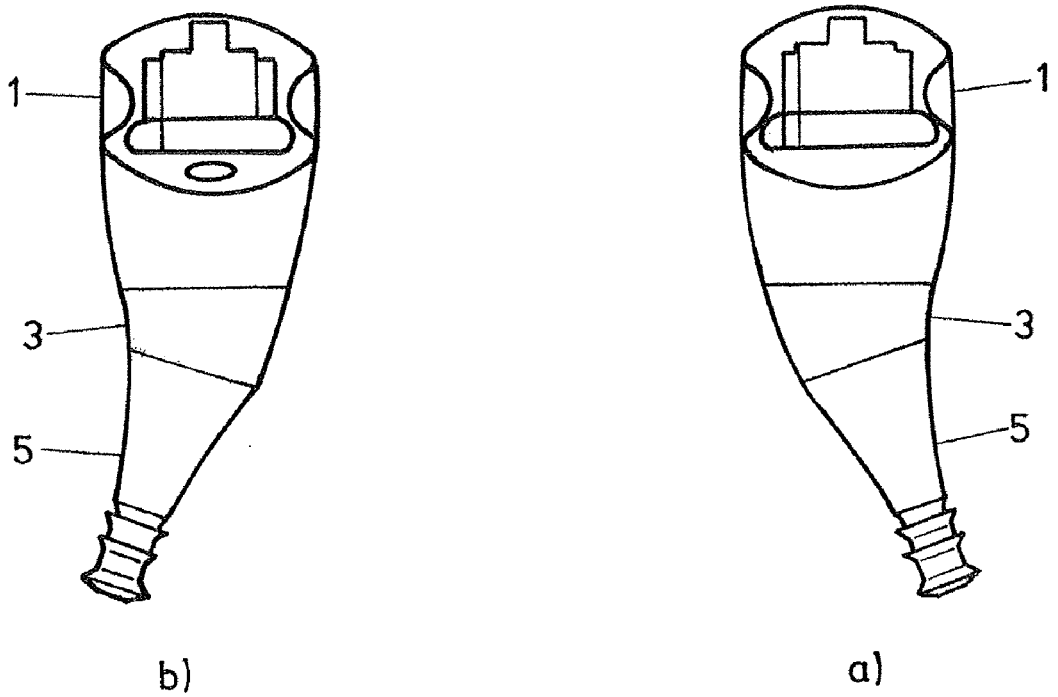
FIGS. 3*a* and 3*b* show an inventive hearing instrument assembled for the use in the right ear and assembled for the use in the left ear of a user, and FIGS. 4*a* and 4*b* the inventive hearing instrument, further comprising a securing feature to prevent over insertion.

FIGS. 3*a* and 3*b* show two possible assemblies of a hearing instrument as proposed according to the present invention. FIG. 3*a* shows the hearing instrument foreseen for being inserted into the right ear of a user person. The middle flexible compartment 3 is arranged such, that the angle between the receiver housing 5 and the hard outer shell 1 corresponds to the angle of the right ear of a user person. In contrast, FIG. 3*b* shows the same hearing instrument, but the middle flexible compartment being arranged reversed, i.e. at an angle turned around 180° compared to the assembled hearing instrument as shown in FIG. 3*a*. As a consequence the same hearing instrument can also be used for the insertion into the left ear of the same user person.

In a similar way of course by arranging the middle flexible compartment in an appropriate way, the same hearing instruments could be used by another user of which the geometry of the ear canal is slightly different. To be able to adjust the mounting of the three parts, it might be preferred that for connecting the three parts a releasable snap mechanism is used, as described with reference to FIG. 1. But of course, also different connections could be used, preferred of course is, if the release of one part to the other can be achieved without the use of a special instrument and also without the danger of damaging one or the other part of the hearing instrument.

Besides, the possibility of using one and the same hearing instrument for the right ear of a user as well as for the left ear of a user, and also for users with different ear canal geometry, another advantage is that the production of such a hearing instrument is universal. In other words, a hearing instrument which can be used for different purposes can easily be produced without the need that for each user the ear canal geometry has to be measured before. In other words, so-called fit-and-go in-the-ear hearing instruments can be produced. Also the service and maintenance for such a hearing instrument is far easier than for a normal custom made ITE hearing instrument.

Figure 4A:
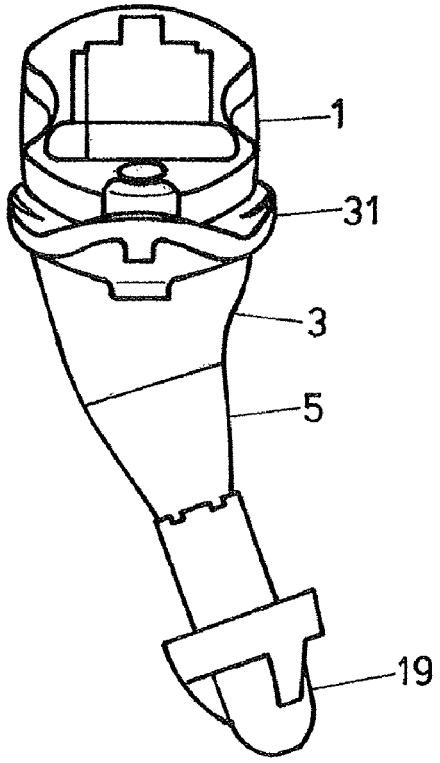
Figure 4B:
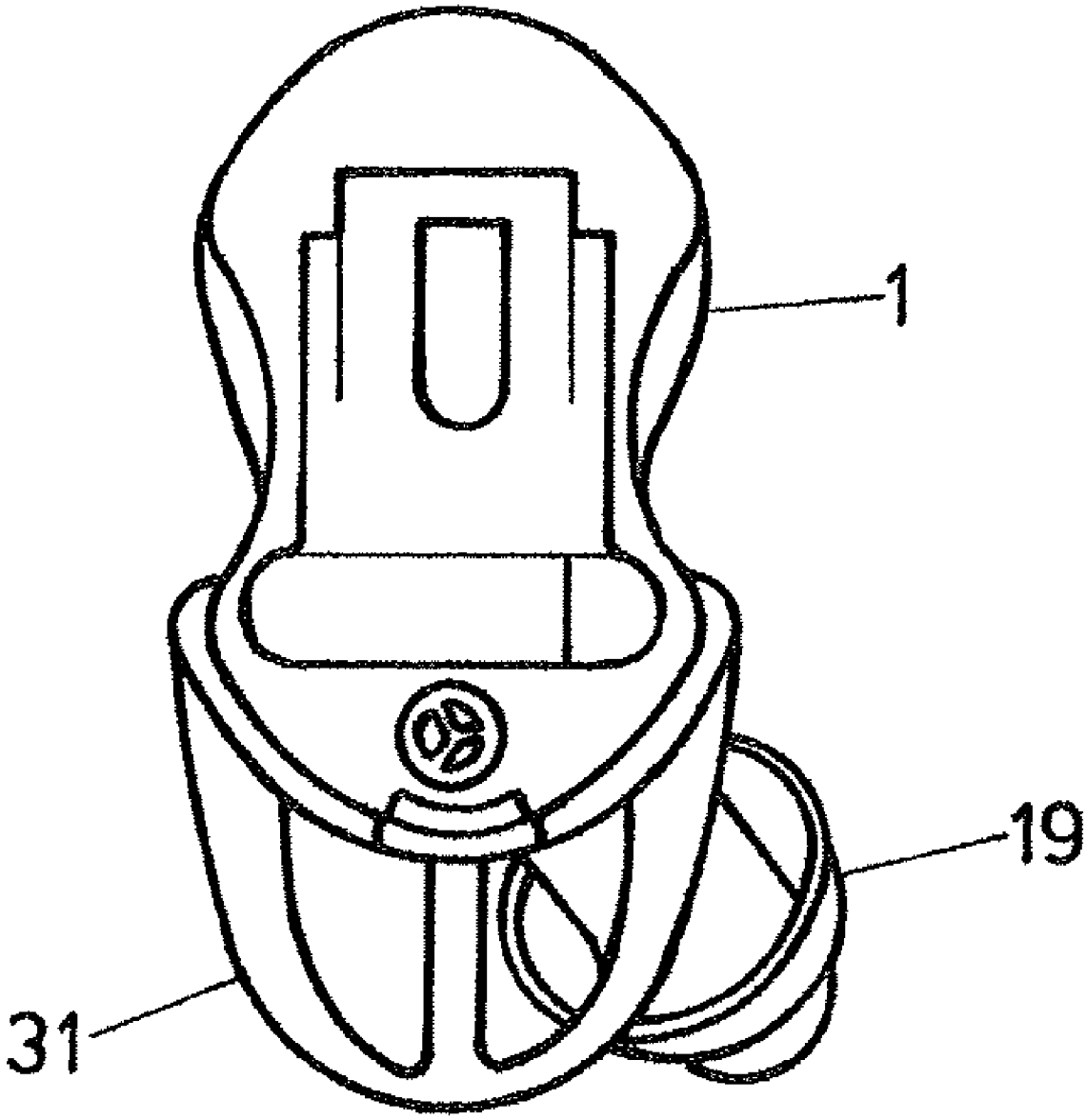

FIGS. 4*a* and 4*b* show in perspective view from the side and from the top the inventive hearing instrument, further comprising a safety feature to prevent over insertion of the hearing instrument into the ear canal. The component 31 to prevent over insertion is a part that can be snapped e.g. onto the shell 1 to help prevent the possibility of over inserting the in-the-ear hearing instrument into patients especially having large ear canals. The component can be snap-removed when it is not desirable to have it included. Furthermore, when included the component 31 to prevent over insertion also may serve as a convenient structure for the user to grab to facilitate the removal of the hearing instrument from the ear physicality.

The examples as shown with reference to FIGS. 1-4 are for the better understanding of the present invention. Of course, the design, the geometry, the way of the assembly etc. can be made in a different way. It is also possible to use flexible materials for all compartments, to use different materials for the three compartments etc. The main issue of the present invention is that the casing of a hearing instrument is made out of various parts which can be arranged in relation one to each other in a different orientation to enable use in a right or in a left ear. Or to have at least one middle part of a three-part shell which is flexible, such to enable the use in ear canals of different users with different ear canal geometry.

Furthermore, it again has to be pointed out that the described example with reference to FIGS. 1 to 4 is not at all restricted to a hearing instrument. In general all kind of hearing systems, hearing protectors, headsets, hearing systems for communication purposes such as wireless information exchange, radio receivers, etc. can be based upon the inventive principles. In other words, all kind of at-the-ear or in-the-ear communication systems can be built based on the principles as above described and listed.

Particularly the application as a generic hearing protector, electronic ear plug is very appealing.

Overall, the comfort and fit rate of key products in the field of hearing ability, hearing protection, communication exchange might be considerably improved.

The invention claimed is:

1. Hearing system and/or earpiece assembly, comprising an assembly structure with at least three parts which correspond to a portion of the earpiece assembly insertable into an ear and are removably connectable, of which at least two parts can be arranged one in relation to the other in a different orientation to facilitate insertion into the ear and at least one part is made out of a flexible material.

2. Hearing system and/or earpiece assembly according to claim 1, characterized in that the middle part is made out of a flexible material.

3. Hearing system and/or earpiece assembly according to claim 1, comprising a hard or rigid shell for the arrangement of electronic parts and a power supply, a receiver housing compartment for the arrangement of a receiver and a middle connecting compartment for the interconnection of the hard shell and the receiver housing compartment.

4. Hearing system and/or earpiece assembly according to claim 1, characterized in that at least two parts or compartments are made out of a flexible and/or elastomeric material.

5. Hearing system and/or earpiece assembly according to claim 1, characterized in that the three parts are connectable to each other via a mechanical snap interlocking mechanism.

6. Hearing system and/or earpiece assembly according to claim 1, characterized in that of the three parts at least one as e.g. the middle part is reversibly mountable, thus resulting in fitting a hearing instrument suitable for the right or the left ear of a user.

7. Hearing system and/or earpiece assembly according to claim 1, further comprising an additional component provided to be attached e.g. by snapping onto the rigid or hard shell and laterally projecting from the shell to help prevent the possibility of over inserting the hearing instrument into the ear canal of persons having large ear canals.

8. Hearing system and/or earpiece assembly according to claim 1, characterized in that the hearing system is a hearing device such as a so-called in-the-ear (ITE) hearing instrument.

9. Hearing system according to claim 1, characterized in that it is a wired or wireless headset, a hearing protector with wired or wireless communication link, a communication exchange and/or transfer device.

* * * * *